US008354802B2

(12) United States Patent
Knapp et al.

(10) Patent No.: US 8,354,802 B2
(45) Date of Patent: Jan. 15, 2013

(54) SOLID STATE DEVICE CONTROLLER

(75) Inventors: Robert C. Knapp, Coloma, MI (US); Henry H. Grell, Jr., Pinckney, MI (US)

(73) Assignee: BGBK, LLC, Pinckney, MI (US)

( * ) Notice: Subject to any disclaimer, the term of this patent is extended or adjusted under 35 U.S.C. 154(b) by 378 days.

(21) Appl. No.: 12/732,577

(22) Filed: Mar. 26, 2010

(65) Prior Publication Data

US 2011/0234117 A1 Sep. 29, 2011

(51) Int. Cl.
*H05B 37/02* (2006.01)

(52) U.S. Cl. ..... 315/291; 315/209 R; 315/312

(58) Field of Classification Search ..... 315/86, 315/209 R, 224, 312
See application file for complete search history.

(56) References Cited

U.S. PATENT DOCUMENTS

| | | | |
|---|---|---|---|
| 7,080,266 | B2 | 7/2006 | D'Angelo et al. |
| 7,161,556 | B2 | 1/2007 | Morgan et al. |
| 7,202,613 | B2 | 4/2007 | Morgan et al. |
| 7,550,931 | B2 | 6/2009 | Lys et al. |
| 7,557,521 | B2 | 7/2009 | Lys |
| 7,564,198 | B2 | 7/2009 | Yamamoto et al. |
| 7,607,798 | B2 | 10/2009 | Panotopoulos |
| 2005/0099138 | A1 * | 5/2005 | Wilhelm ..... 315/209 R |
| 2007/0228835 | A1 * | 10/2007 | Varzhabedian ..... 307/66 |
| 2007/0271403 | A1 * | 11/2007 | Kojori ..... 710/302 |
| 2009/0027932 | A1 * | 1/2009 | Haines et al. ..... 363/95 |
| 2012/0025017 | A1 * | 2/2012 | Lee ..... 244/118.5 |

* cited by examiner

*Primary Examiner* — Don Le
(74) *Attorney, Agent, or Firm* — Price Heneveld LLP

(57) ABSTRACT

A solid state device controller is provided that includes a first electrical connector configured to be in electrical communication with an alternating current (AC) electrical power source and a second electrical connector in electrical communication with the first electrical connector, wherein the second electrical connector is configured to be in electrical communication with a direct current (DC) electrically powered device. The controller further includes circuitry in communication between the first electrical connector and the second electrical connector, wherein the circuitry is configured to convert the supplied AC electrical power to DC electrical power, and a housing configured to enclose at least a portion of the first electrical connector, the second electrical connector, and the circuitry, wherein the housing is further configured to be removably received by a service panel assembly.

22 Claims, 6 Drawing Sheets

SOLID STATE DEVICE CONTROLLER

FIELD OF THE INVENTION

The present invention generally relates to solid state device controller, and more particularly, a solid state light controller that supplies electrical power to a direct current electrically powered device.

BACKGROUND OF THE INVENTION

Generally, a facility, such as a building structure or other area that is supplied with electrical power, has one or more service panels that are supplied with alternating current (AC) electrical power from a main power source (e.g., a power plant). Typically, these service panels include circuit breakers that are either one hundred twenty volts AC (120 Vac) or two hundred forty volts AC (240 Vac), and protect the devices electrically connected to the service panel. If a device electrically connected to the circuit breaker is a direct current (DC) device, the device generally converts the supplied AC electrical power to DC electrical power. Each DC device electrically connected to the circuit breaker typically include a ballast, a transformer, and heat reflectors for converting the AC electrical power to DC electrical power.

SUMMARY OF THE INVENTION

According to one aspect of the present invention, a solid state device controller includes a first electrical connector configured to be in electrical communication with an alternating current (AC) electrical power source and a second electrical connector in electrical communication with the first electrical connector, wherein the second electrical connector is configured to be in electrical communication with a direct current (DC) electrically powered device. The controller further includes circuitry in communication between the first electrical connector and the second electrical connector, wherein the circuitry is configured to convert the supplied AC electrical power to DC electrical power, and a housing configured to enclose at least a portion of the first electrical connector, the second electrical connector, and the circuitry, wherein the housing is further configured to be removably received by a service panel assembly.

According to another aspect of the present invention, a DC service panel configured to receive AC electrical power from an AC service panel assembly is provided, wherein the DC service panel includes at least one solid state device light controller configured to be in electrical communication with the AC service panel assembly. The at least one solid state device controller includes a first electrical connector configured to be electrically connected to an AC electrical power source and a second electrical connector in electrical communication with the first electrical connector, wherein the second electrical connector is configured to be electrically connected to a DC electrically powered device, circuitry in communication between the first electrical connector and the second electrical connector, wherein the circuitry is configured to convert the supplied AC electrical power to DC electrical power, and a housing configured to enclose at least a portion of the first electrical connector, the second electrical connector, and the circuitry.

According to yet another aspect of the present invention, a solid state device controller includes a first electrical connector configured to be electrically connected to a DC renewable energy electrical power source, a second electrical connector in electrical communication with the first electrical connector, wherein the second electrical connector is configured to be electrically connected to a DC electrically powered device, circuitry in communication between the first electrical connector and the second electrical connector, wherein the circuitry is configured to convert the supplied DC electrical power to DC electrical power supplied to the DC electrically powered device, and a housing configured to enclose at least a portion of the first electrical connector, the second electrical connector, and the circuitry, wherein the housing is further configured to be removably received by a service panel assembly.

BRIEF DESCRIPTION OF THE DRAWINGS

The present invention will now be described, by way of example, with reference to the accompanying drawings, in which.

DETAILED DESCRIPTION

Figure 1:
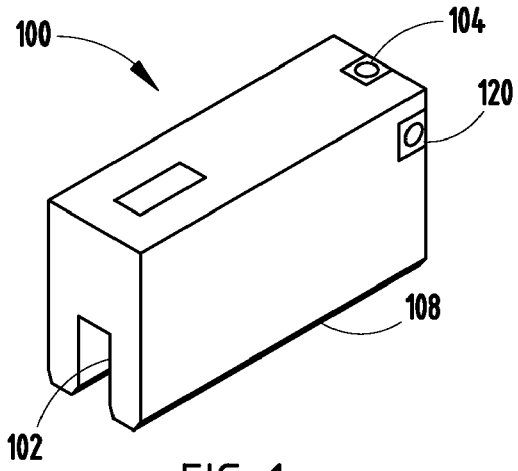
FIG. 1 is a front-side perspective view of a solid state device controller, in accordance with one embodiment of the present invention.

Reference will now be made in detail to present embodiments of the invention, examples of which are illustrated in the accompanying drawings. Wherever possible, the same reference numerals will be used throughout the drawings to refer to the same or like parts.

For purposes of description herein, the terms "upper," "lower," "right," "left," "rear," "front," "vertical," "horizontal," "top," "bottom," and derivatives thereof shall relate to the invention as shown in the drawings. However, it is to be understood that the invention may assume various alternative orientations, except where expressly specified to the contrary. It is also to be understood that the specific device illustrated in the attached drawings and described in the following specification is simply an exemplary embodiment of the inventive concepts defined in the appended claims. Hence, specific dimensions, proportions, and other physical characteristics relating to the embodiment disclosed herein are not to be considered as limiting, unless the claims expressly state otherwise.

With respect to FIG. 1, a solid state device controller is generally shown at reference identifier 100. The solid state device controller 100 can include a first electrical connector 102 (FIGS. 1-4) configured to be in electrical communication with an alternating current (AC) electrical power source 103, and a second electrical connector 104 (FIGS. 1-6) in electrical communication with the first electrical connector 102, wherein the second electrical connector 104 is configured to be in electrical communication with a direct current (DC) electrically powered device 105. According to one embodiment, the electrical communication between the solid state device controller 100 and the DC electrically powered device can include superimposing a signal on a DC feedline, supplying the DC electrical power to the DC electrically powered device, or a combination thereof. The solid state device controller 100 can further include circuitry 106 that is in communication between the first electrical connector 102 and the second electrical connector 104, wherein the circuitry 106 is configured to convert the supplied AC electrical power to the DC electrical power. Further, the solid state device controller 100 can include a housing 108 (FIG. 1) configured to enclose at least a portion of the first electrical connector 102, the second electrical connector 104, and the circuitry 106, wherein the housing 108 is further configured to be removably received by a service panel assembly 109 (FIGS. 2-6), as described in greater detail herein.

According to one embodiment, the solid state device controller 100 can be utilized to control DC electrically powered devices 105, such as, but not limited to, a light emitting diode (LED) lighting device. However, it should be appreciated by those skilled in the art that the description and illustrations contained herein as to the solid state device being a lighting device is for purposes of explanation and not limitation, and that other suitable devices can be utilized. Typically, the solid state device controller 100 is located in the power system, wherein the outputted DC electrical power can be supplied to one or more DC electrically powered devices 105, so that each DC electrically powered device 105 does not need to have the circuitry for converting AC electrical power to DC electrical power. In an embodiment that utilizes a plurality of DC electrically powered devices 105, the DC electrically powered devices 105 can be the same device, different devices, or a combination thereof.

According to one embodiment, the solid state device controller 100 can be configured to replace at least one standard AC-to-AC circuit breaker in the service panel assembly 109. The solid state device controller 100 can further include a controller 110 in communication with the first electrical connector 102, the second electrical connector 104, the circuitry 106, or a combination thereof, wherein the controller 110 is configured to control the conversion of the supplied AC electrical power input to the emitted DC electrical power output. Typically, the controller 110 is configured to execute one or more executable software routines for controlling the conversion of the supplied AC electrical power to the DC electrical power. The one or more executable software routines can be stored in a memory device of the controller 110, stored in a memory device in communication with the controller 110, or a combination thereof. Further, the controller 110 can be configured to be in communication with a master controller 112 (FIG. 9), wherein the master controller 112 can be configured to be in communication with the AC electrical power source 103, the DC electrically powered device 105, or a combination thereof.

Additionally or alternatively, the circuitry 106 can be one or more hardware components, one or more software components, or a combination thereof. Typically, in an embodiment that utilizes the software component, the software component includes one or more executable software routines.

Figure 2:
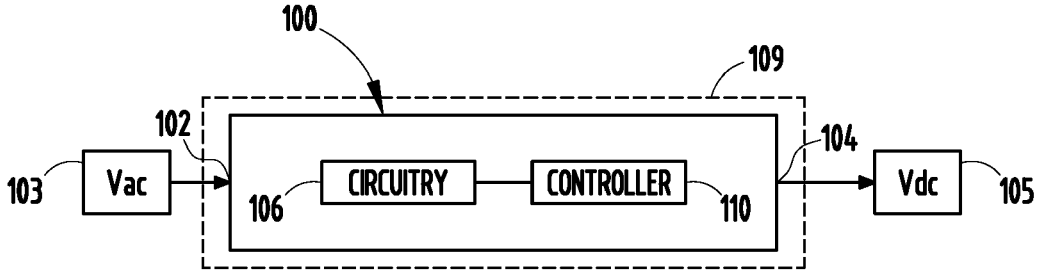
FIG. 2 is a block diagram of a service panel assembly including at least one solid state device controller configured to receive a Vac input and emit a Vdc output, in accordance with one embodiment of the present invention.
Figure 3:
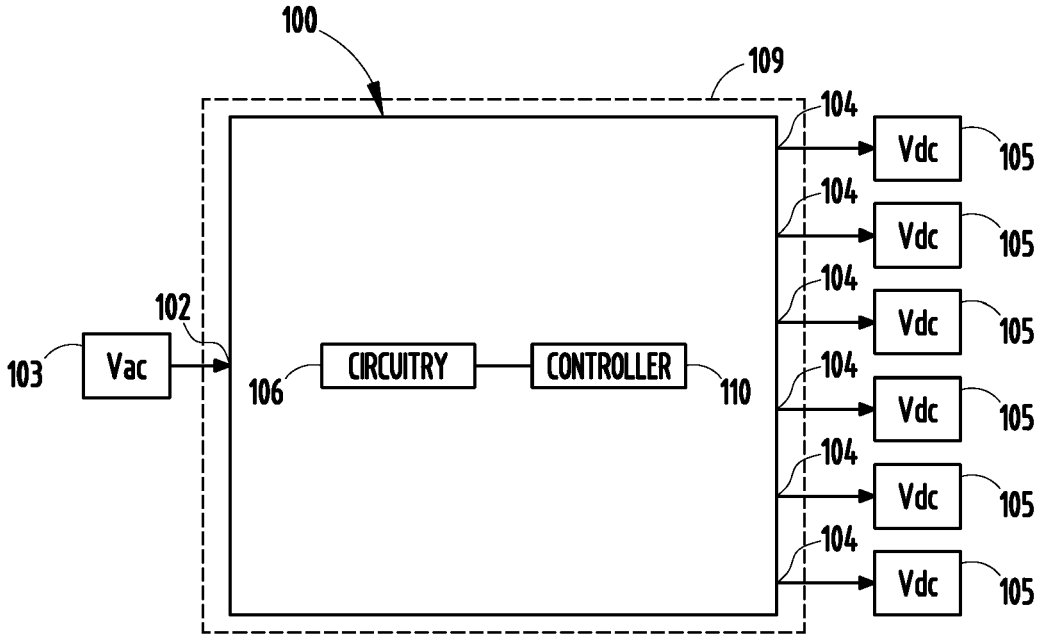
FIG. 3 is a block diagram of a service panel assembly including at least one solid state device controller configured to receive a single Vac input and emit a plurality of Vdc outputs, in accordance with one embodiment of the present invention.

By way of explanation and not limitation, FIG. 1 illustrates a solid state device controller 100 having the housing 108 being configured to be received by the standard service panel assembly 109. FIG. 2 exemplary illustrates an embodiment where the solid state device controller 100 receives a single AC electrical power input and emits the DC electrical powered output to a single DC electrically powered device 105. FIG. 3 exemplary illustrates an embodiment where the solid state device controller 100 receives a single AC electrical power input and emits the DC electrical powered output to a plurality of DC electrically powered devices 105. With respect to FIGS. 2, 3, 5, and 6, the service panel assembly 109 can be configured to receive one or more solid state device controllers 100.

Figure 4:
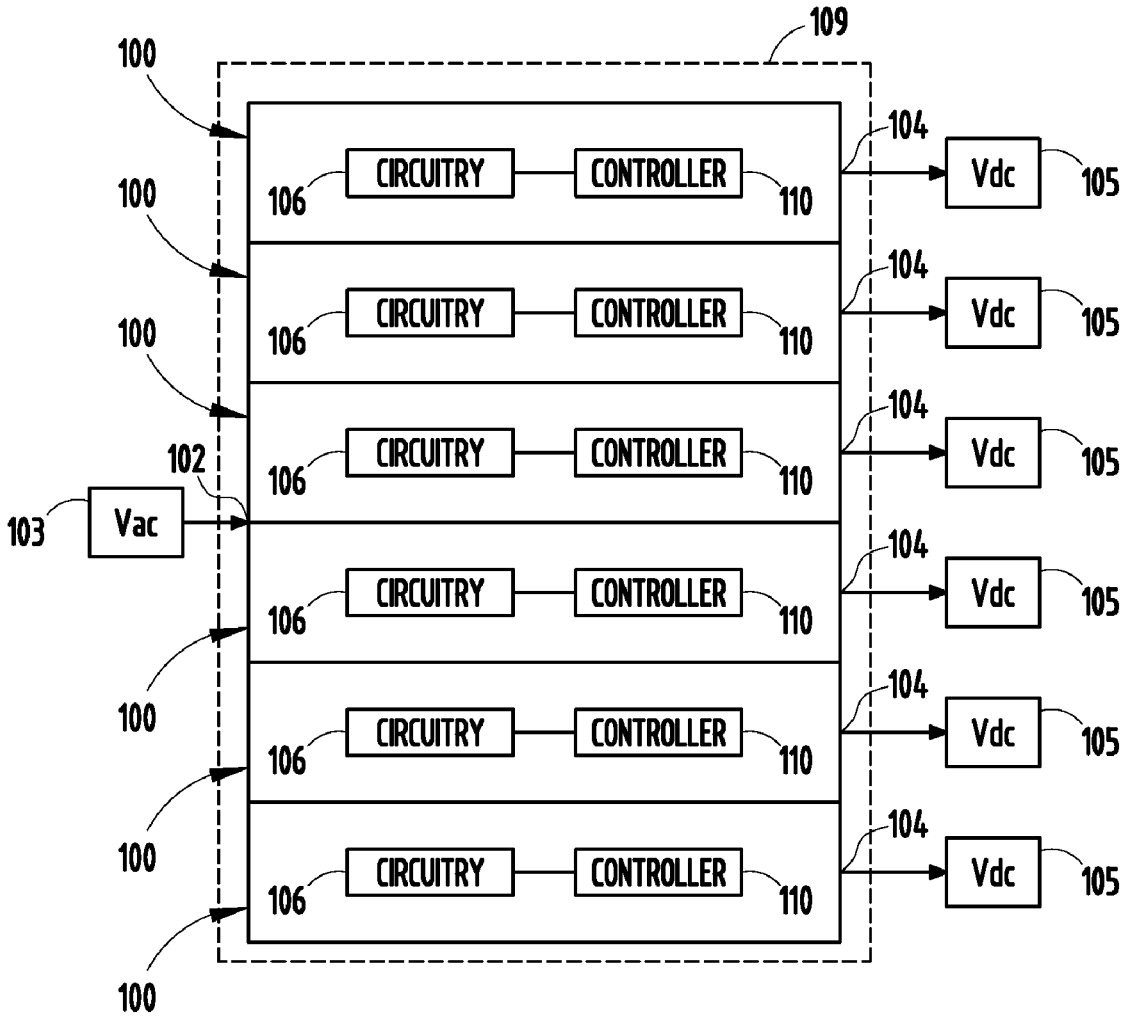
FIG. 4 is a block diagram of a service panel assembly including a plurality of solid state device controllers configured to receive a single Vac input and each configured to emit a Vdc output, in accordance with one embodiment of the present invention.
Figure 5:
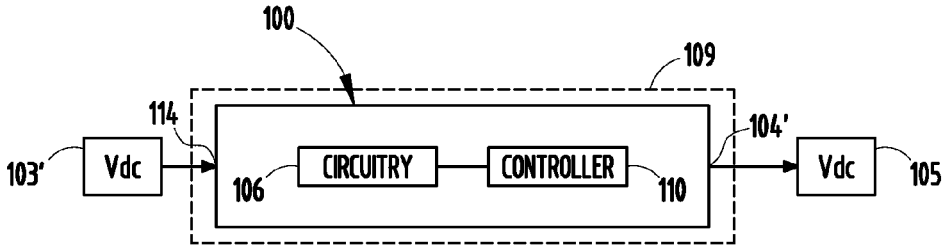
FIG. 5 is a block diagram of a service panel assembly including at least one solid state device controller configured to receive a Vdc input and emit a Vdc output, in accordance with one embodiment of the present invention.

In regards to FIG. 4, the solid state device controller 100 can include a plurality of first electrical connectors and a plurality of second electrical connectors, such that the solid state device controller 100 replaces all of the standard AC-to-AC circuit breakers in the service panel assembly 109. Alternatively, the plurality of solid state device controllers 100 can be a separate DC service panel assembly 109 from an AC service panel. Thus, the DC service panel assembly 109 can receive the AC electrical power from the AC electrical power source 103, or from an AC electrical power source 103 via the AC service panel assembly 109. According to one embodiment, the service panel assembly 109 includes one or more AC-to-AC circuit breakers, one or more solid state device controllers 100, or a combination thereof.

According to one embodiment, the solid state device controller 100 can be in thermal communication with the service panel assembly 109, such that the service panel assembly 109 is configured as a heat sink for the solid state device controller 100. In such an embodiment, a solid conductive plate, such as, but not limited to, an aluminum plate can be used as a heat sink for a switching power supply with thermal protection. Typically, the second electrical connector 104 has voltage potential of approximately five to fifty volts DC (5-50 Vdc). However, it should be appreciated by those skilled in the art that the solid state device controller 100 can have electrical connectors, such as, but not limited to, the second electrical connector 104 that has other suitable DC voltage potentials.

Figure 6:
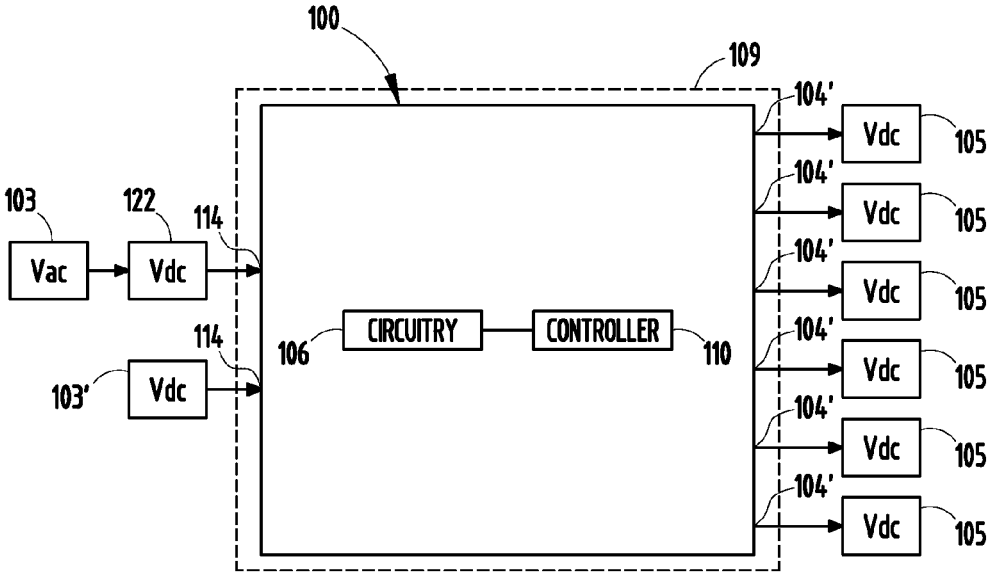
FIG. 6 is a block diagram of a service panel assembly including at least one solid state device controller configured to receive a plurality of Vdc inputs and emit a plurality of Vdc outputs, in accordance with one embodiment of the present invention.
Figure 7:
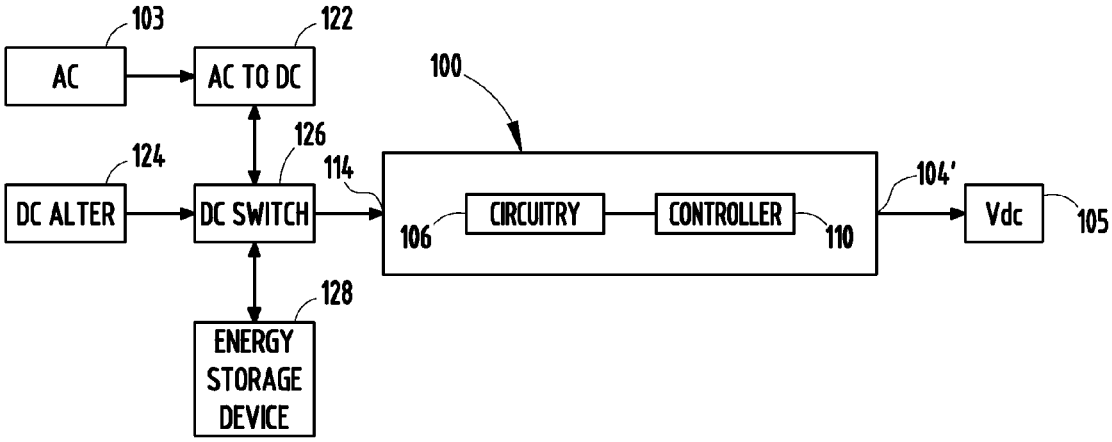
FIG. 7 is a block diagram of a system that includes a solid state device controller that is configured to receive a Vdc input from a renewable energy source and emit a Vdc output, in accordance with one embodiment of the present invention.

In regards to FIG. 6, the solid state device controller 100 can further include a third electrical connector 114 and a fourth electrical connector 104'. The third electrical connector 114 can be configured to be in electrical communication with a DC electrical power source 103'. The fourth electrical connector 104' can be in electrical communication with the third electrical connector 114, wherein the fourth electrical connector 104' is configured to be in electrical communication with a DC electrically powered device 105. Typically, the DC electrical power source 103' that is in electrical communication with the third electrical connector 114 is a renewable energy power source. For purposes of explanation and not limitation, the renewable energy power source can be solar photovoltaic panel power source, wind turbine, a hydro power source, the like, or a combination thereof. However, it should be appreciated by those skilled in the art that the DC electrical power source 103' can be suitable types of DC electrical power sources other than renewable energy power sources, such as, but not limited to, an energy storage device (e.g., a battery), a power distribution system in a vehicle, or the like.

Typically, the solid state device controller 100 can be configured to replace an existing circuit breaker (e.g., an AC circuit breaker) in the service panel assembly 109 to protect existing lighting circuits, such that replacing the standard AC-to-AC circuit breakers in the service panel assembly allows the solid state device controller 100 to convert the AC voltage to a DC voltage to drive the DC electrically powered device 105 (e.g., a solid state lighting device). According to one embodiment, the DC voltage can have a range of approximately five to fifty volts DC (5-50 Vdc), and such replacement of the AC-to-AC circuit breaker can eliminate the need of a ballast, a transformer, one or more heat reflectors, the like, or combination thereof, in the DC electrically powered device 105. However, it should be appreciated by those skilled in the art that the DC voltage can be other suitable DC voltages or ranges of DC voltages. Thus, the solid state device (e.g., the DC electrically powered device 105) that is supplied the emitted DC electrical power from the solid state device controller 100 can be efficiently and economically manufactured, since it does not need components for converting one hundred twenty volts AC (120 Vac) or two hundred seventy volts AC (270 Vac) to a DC voltage. In an embodiment wherein the DC electrically powered device 105 is a solid state lighting device, the solid state device controller 100 typically includes a step down circuit to drive the one or more LEDs.

Figure 8A:
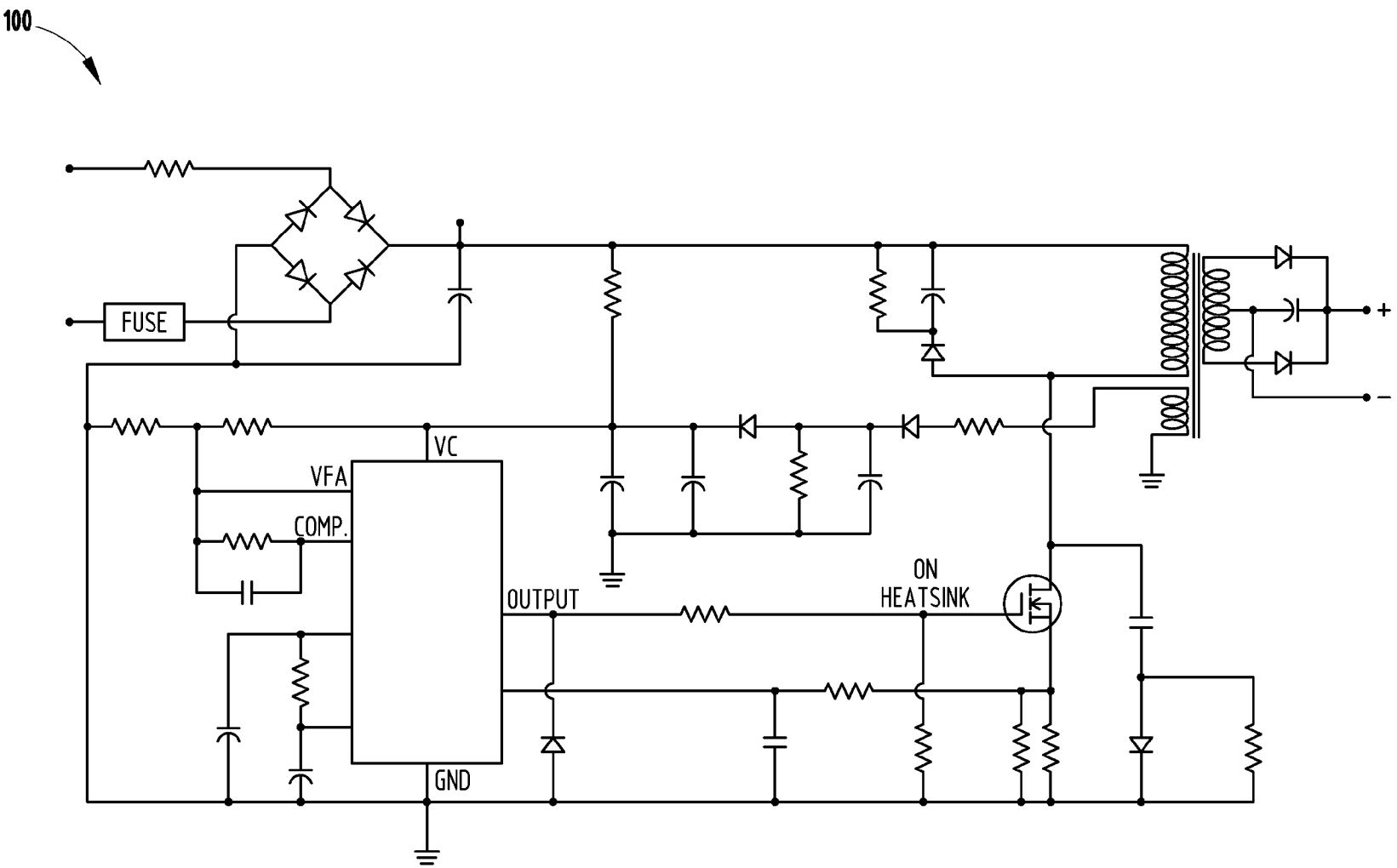
FIG. 8A is a circuit schematic of a switching power supply, in accordance with one embodiment of the present invention.
Figure 8B:
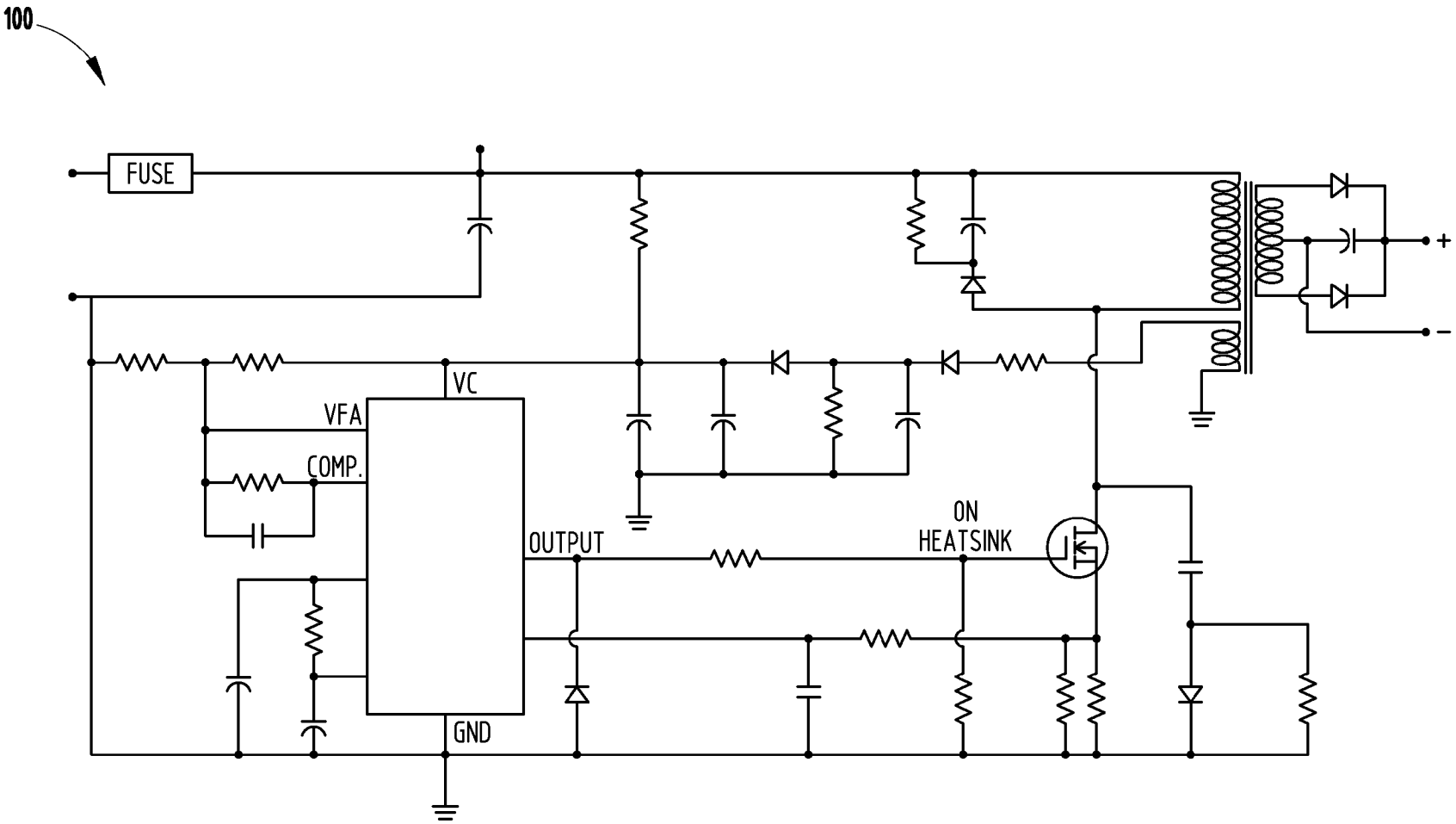
FIG. 8B is a circuit schematic of a switching power supply, in accordance with one embodiment of the present invention.

As illustrated in FIGS. 8A and 8B, the solid state lighting controller 100 typically includes a switching power supply. The switching power supply can be configured to convert an AC voltage to a DC voltage, or convert a DC voltage to another DC voltage. After a conversion, a substantially constant DC electrical current can be supplied to the DC electrically powered device 105. The circuitry 106 can provide surge protection in addition to, or in alternative of, short circuit protection.

With respect to FIG. 8A, a plurality of 1N4005 diodes can be utilized as a bridge rectifier to convert the AC electrical power input to a DC electrical power output, according to one embodiment. Alternatively, a one amp (1A) bridge rectifier can be utilized. Typically, at least a portion of the plurality of diodes can be high speed types with suitable voltage and current ratings. By way of explanation and not limitation, a primary coil of an inductor can have approximately thirty three (33) turns, a gap between the primary coil and a secondary coil of the indicator can be approximately 0.0025 inches, an inductance of the inductor can be approximately one thousand microHenry (1000 μH), one or more resistors can have a value of four kilohms (4 KΩ), twenty kilohms (20 KΩ), fifteen kilohms (15 KΩ), two kilohms (2 KΩ), one hundred ohms (100Ω), ten kilohms (10 KΩ), twenty two ohms (22Ω), one kilohm (1 KΩ), or sixty eight ohms (68Ω), and one or more capacitors can have a value of two hundred fifty microfarads (250 μF), 0.022 μF, forty seven microfarads (47 μF), 0.22 μff, one hundred microfarads (100 μF), one hundred picofarads (100 pF), 0.1 F, 0.0022 F, four hundred seventy picofarads (470 pF), and six hundred eighty picofarads (680 pF).

In regards to FIG. 8B, this exemplary circuitry 106 can be used when the power source is a DC power source, such as, but not limited to, a renewable energy power source. Typically, a DC-to-DC conversion is utilized, as an AC-to-DC is not needed. At least a portion of the plurality of diodes can be high speed types with suitable voltage ratings and current ratings, according to one embodiment. For purposes of explanation and not limitation, a primary coil of an inductor can have approximately thirty three (33) turns, a gap between the primary coil and a secondary coil of the inductor can be approximately 0.0025 inches, an inductance of the inductor can be approximately one thousand microHenry (1000 μH), one or more resistors can have a value of fifty six kilohms (56 Ku), four kilohms (4 KΩ), twenty kilohms (20 KΩ), four kilohms (4 KΩ), one hundred ohms (100Ω), one hundred fifty kilohms (150 KΩ), ten kilohms (10 KΩ), twenty two ohms (22Ω), one kilohm (1 KΩ), two kilohms (2 KΩ), and sixty eight ohms (68Ω), and one or more capacitors can have a value of two hundred fifty microfarads (250 μff), 0.0022 μF, forty seven microfarads (47 μF), 0.22 μF, one hundred microfarads (100 μF), one hundred picofarads (100 pF), 0.0022 F, four hundred seventy picofarads (470 pF), and six hundred eighty picofarads (680 pF).

Typically, the solid state device controller 100 can have an input AC terminal (e.g., the first electrical connector 102), an output DC terminal (e.g., the second electrical connector 104), and a ground connector 120 (FIG. 1). Typically, the ground connector 120 can be used as a ground/negative connection. Additionally or alternatively, the ground connection 120 can be at least a portion of a heat sink connection to the service panel assembly 109, such that the ground connection 120 and/or the service panel 109 can be configured to dissipate heat from the solid state device controller 100. A snap tab or other suitable type of mechanical connection can be configured to removably secure the solid state device controller 100 to the service panel assembly 109, and can be further configured as a heat sink connection between the solid state device controller 100 and the service panel assembly 109, alone, or in combination with the ground connection 120, according to one embodiment.

The solid state device controller 100 can be used to replace one or more standard AC-to-AC breakers or have a similar configuration thereof for use in other types of service panels. In such an embodiment, a standard single pole breaker size can typically convert at least twenty amp (20A) current source and a standard double pole breaker size can typically double the output, wherein the solid state device controller 100 can be configured to operate in a similar manner. Thus, the solid state device controller 100 can be configured for single pole application or multiple pole applications.

According to one embodiment, the solid state device controller 100 can be used to retrofit into existing service panel assemblies 109; however, the solid state device controller 100 can be used in new constructions. In a new construction scenario (e.g., not retrofitting), a two-wire power distribution system can be utilized between the solid state device controller 100 and the DC electrically powered device 105, since a DC voltage of approximately 50 Vdc or less can be used. Thus, such a two-wire power distribution system can have a reduced cost as compared to a three-wire power distribution system. Additionally or alternatively, wiring in a new construction scenario can be configured to removably electrically connect to DC electrically powered fixtures.

Figure 9:
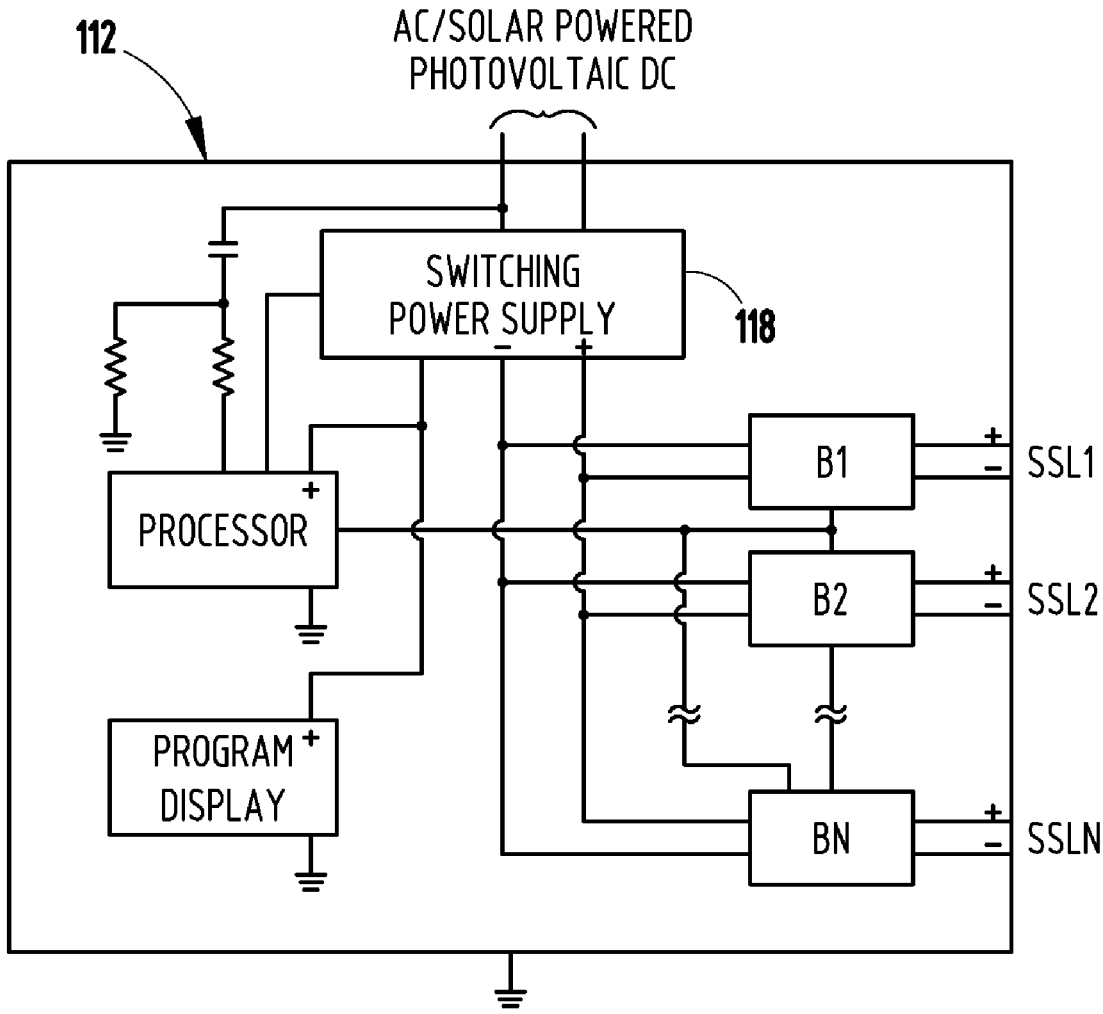
FIG. 9 is a block diagram of a master control panel, in accordance with one embodiment of the present invention.

In either of a retrofit or new construction embodiments, the master controller 112 can be included, which is generally indicated in FIG. 9 at reference identifier 112. The master controller 112 can have circuitry for converting the incoming AC voltage to a DC voltage using a switching power device 118. The master controller 112 can be an intelligent communicator to the solid state device controller 100, one or more of the DC electrical powered devices 105, one or more of the DC electrical power source 103', one or more of the AC electrical power source 103, the like, or a combination thereof. In such an embodiment, the master controller 112 can be in communication with a smart grid from the AC power source.

In embodiments wherein the solid state device controller 100, master controller 112, or a combination thereof, include intelligence, these devices can program control zone lighting and facilitate one location, such as turning ON or OFF lighting by a timer, a motion sensor, an ambient light sensor, the like, or a combination thereof. Further, the color of the lighting can be controlled, such as, but not limited to, for emergency or warning alerts, zone lighting can detect ambient light level, and dim the solid state lighting device output to keep a constant light level which can be done by using an active light sensor or a photodiode, and the incoming power grid can be connected to use a smart grid communication information to control lighting. It should be appreciated by those skilled in the art that the solid state device controller 100, master controller 112, or a combination thereof can be used to control other suitable devices in desirable ways.

The solid state device controller 100 in combination with a DC electrically powered device 105 (e.g., a DC electrically powered lighting device) can provide for energy savings over fluorescent (CFL) technology and allow for more flexibility, according to one embodiment. For purposes of explanation and not limitation, the solid state device controller 100 in combination with the DC electrically powered lighting device 105 can be used for keeping substantially constant lighting, which can provide an enhanced and healthier condition, and the solid state device controller 100 can reduce cost and improve performance of equipment because of reduced electromagnetic interference (EMI) or radio frequency interference (RFI) that the CFLs typically produce. Also, the use of DC electrical power can be advantageous, since a reduced voltage is being used, and there can be reduced installation requirements and cost.

According to one embodiment, the solid state device controller 100 and DC electrically powered device 105 (e.g., a DC electrically powered lighting device) can be used where indoor lighting systems include a separate automatic shut-off control, such as an occupancy or vacancy sensor, a time switch, other suitable shut-off device, or a combination thereof, automatic reduction in lighting powers in areas where the ambient light can help illuminate the space from exterior sources, such that the area can be controlled by dimming at least fifty percent (50%) of general power. Further, outdoor lighting can be controlled by photo control or astronomical time switch that automatically turns off the lighting during daylight hours. These above advantages can typically be done by utilizing the controller 110 of the solid state device controller 100, the master controller 112, or a combination thereof. However, it should be appreciated by those skilled in the art that additional or alternative advantages may be present from the elements and combinations thereof described herein.

Further, by having intelligence, the power grid can determine if the supplied power is at capacity, such that the system can reduce demand by either shutting off areas without occupancy or reducing the amount of light luminance required by dimming. Typically, diming can be accomplished by pulse width modulation output of the DC electrical power from the solid state device controller 100. Additionally or alternatively, a lighting system that has a junction box that feeds several lighting fixtures can be configured so that the junction box is located in an area that can provide communication of light levels occupancy, a timer, the like, or a combination thereof, and light fixtures can have communication built in for feed back to the master controller 112, the controller 110 of the solid state device controller 100, the junction box, or a combination thereof.

By including at least one of the controller 110 in the solid state device controller 100 or the processor in the master controller 112, a system can be an intelligent system. Thus, the controller 110 of the solid state device controller 100, the processor of the master controller 112, or a combination thereof, can be configured to transmit data, receive data, or act as a pass-through. By way of explanation and not limitation, such data that can be communicated can include electrical power consumption, maintenance, other data to enhance efficiency, the like, or a combination thereof. Additionally, the solid state device controller 100, the master controller 112, or a combination thereof, can have wireless capabilities. Thus, the devices in the system can communicate with one another via a wired network, a wireless network, or a combination thereof. Further, the devices in the system can communicate with external devices, such as, but not limited to, devices connected via the Internet, cell phones, the like, or a combination thereof. For purposes of explanation and not limitation, the wireless network can be a WiFi™ network, a Bluetooth® network, ZigBee® network, WiMAX™ network, the like, or a combination thereof.

In regards to FIGS. 5-7 and 8B, according to an embodiment where renewable energy sources are providing DC electrical power, the DC electrical power supplied to the solid state device controller 100 typically has a greater DC voltage potential than a DC voltage potential of the DC electrical power outputted from the solid state device controller 100. In regards to FIG. 7, a system that utilizes a DC power source, such as, but not limited to, a renewable energy power source, can include a DC alternator 124, which is typically part of the renewable energy power source device and configured to convert mechanical power to electrical power. The system can further include a DC switch 126 in electrical communication with an AC-to-DC converter 122 that is supplied with AC electrical power from the AC power source 103, and the DC switch 126 can be in electrical communication with the DC alternator 124. An energy storage device 128 (e.g., one or more batteries) can be in electrical communication with the DC switch 126, and configured to store electrical power supplied from the AC power source 103, the DC alternator 124, or a combination thereof. The DC switch 126 can also be in electrical communication with the solid state device controller 100.

For purposes of explanation and not limitation, when a solar photovoltaic panel is being used, this power source can then provide a DC voltage ranging from approximately seven to three hundred volts DC (7-300 Vdc). The solid state device controller 100 can then convert the DC voltage to approximately five to fifty volts DC (5-50 Vdc). However, the conversion circuitry typically does not need an inverter, which is generally needed when AC electrical power is supplied to the solid state device controller 100. Further, in such an embodiment, the DC power supplied from the renewable energy source does not need to be converted to AC as typically done when a standard service panel assembly 109 is utilized with a renewable energy source.

In addition to any embodiments described herein, at least a portion of the housing 108 of the solid state device controller 100 can be color coded. In such an embodiment, any colors can be used, but typically not black, as standard AC-to-AC breakers are generally black. Thus, the color coding can be used to easily identify the solid state device controller 100 from standard AC-to-AC breakers, distinguish between different types of solid state device controllers 100 (e.g., depending upon a type of DC electrically powered device 105 that is connected thereto), the like, or a combination thereof. By way of explanation and not limitation, at least a portion of the housing 108 can be green, blue, red, yellow, pink, white, purple, the like, or a combination thereof.

Advantageously, the solid state device controller 100 can be retrofitted into a standard service panel assembly 109 to supply DC electrical power to DC electrically powered devices 105. Thus, the DC electrically powered device 105 that is in electrical communication with the solid state device controller 100 does not need to have the capability of converting AC electrical power or higher voltage DC electrical power to DC electrical power at a desired voltage for operation, and the solid state device controller 100, one or more components in electrical communication therewith, or a combination thereof can have intelligence to communicate with other components. It should be appreciated by those skilled in the art that additional or alternative advantages may be present from the elements and combinations thereof described herein. It should further be appreciated by those skilled in the art that the components described herein can be combined in additional or alternative manners.

Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

What is claimed is:

1. A solid state device controller comprising:

a first electrical connector configured to be in electrical communication with an alternating current (AC) electrical power source;

a second electrical connector in electrical communication with said first electrical connector, wherein said second electrical connector is configured to be in electrical communication with a direct current (DC) electrically powered device;

circuitry in communication between said first electrical connector and said second electrical connector, wherein said circuitry is configured to convert said supplied AC electrical power to DC electrical power; and a housing configured to enclose at least a portion of said first electrical connector, said second electrical connector, and said circuitry, wherein said housing is further configured to be removably received by a service panel assembly.

2. The solid state device controller of claim 1 configured to replace at least one standard AC-to-AC circuit breaker in said service panel assembly.

3. The solid state device controller of claim 1 further comprising a controller in communication with at least one of said first electrical connector, said second electrical connector, and said circuitry, wherein said controller is configured to control said conversion of said supplied AC electrical power input to emitted said DC electrical power output.

4. The solid state device controller of claim 3, wherein said controller is configured to be in communication with a master controller, wherein said master controller is configured to be in communication with at least one of said AC electrical power source and said DC electrically powered device.

5. The solid state device controller of claim 1 further comprising a plurality of first electrical connectors and a plurality of second electrical connectors, such that said solid state device controller replaces all of said standard AC-to-AC circuit breakers in said service panel assembly.

6. The solid state device controller of claim 1 in thermal communication with said service panel assembly, such that said service panel assembly is configured as a heat sink for said solid state light controller.

7. The solid state device controller of claim 1, wherein said second electrical connection has a voltage potential of approximately five volts direct current (5 Vdc) to fifty volts direct current (50 Vdc).

8. The solid state light controller of claim 1 further comprising:

a third electrical connector configured to be in electrical communication with a DC power source; and a fourth electrical connector in communication with said third electrical connector, said fourth electrical connector configured to be in electrical communication with a second DC electrically powered device.

9. The solid state light controller of claim 1 further comprising a controller in communication with said circuitry, wherein said controller is configured to communicate with at least one of said AC electrical power source, said DC electrically powered device, a master controller, and an external device.

10. The solid state light controller of claim 9, wherein said controller is configured to at least one of transmit data, receive data, and function as a pass-through for other communications.

11. The solid state light controller of claim 9, wherein said communications compare data that is utilized to operate at least one of said solid state device controller and said DC electrically powered device to enhance efficiency thereof.

12. A service panel configured to receive alternating current (AC) electrical power from an AC service panel assembly, said service panel comprising:

at least one solid state device controller configured to be electrical communication with the AC service panel assembly, said at least one solid state device controller comprising:

first electrical connector configured to be electrically connected to AC electrical power source;

a second electrical connector in electrical communication with said first electrical connector, wherein said second electrical connector is configured to be electrically connected to a DC electrical powered device;

circuitry in communication between said first electrical connector and said second electrical connector, wherein said circuitry is configured to convert said supplied AC electrical power to a pulse width modulated (PWM) electrical power; and a housing configured to enclose at least a portion of said first electrical connector, said second electrical connector, and said circuitry.

13. The DC service panel of claim 12, wherein said solid state device controller further comprising a controller in communication with at least one of said first electrical connector, said second electrical connector, and said circuitry, said controller is configured to control said conversion of said supplied AC electrical power input to emitted said PWM electrical power output.

14. The DC service panel of claim 12, further comprising a controller that is configured to be in communication with at least one of a master controller, said AC electrical power source, said DC electrical powered device, and a controller of said solid state device controller.

15. The DC service panel of claim 12, configured to be in thermal communication with said solid state device controller, such that said service panel assembly is configured as a heat sink for said solid state light controller.

16. The DC service panel of claim 12, wherein said second electrical connection of said solid state device controller has a voltage potential of approximately five volts direct current (5 Vdc) to fifty volts direct current (50 Vdc).

17. The DC service panel of claim 12 further comprising at least one second solid state device controller that comprises:

a third electrical connector configured to be in electrical communication with a DC electrically power source; and a fourth electrical connector in communication with said third electrical connector, said fourth electrical connector configured to be in electrical communication with a PWM device.

18. The DC service panel of claim 17, wherein said DC power source is a renewable energy power source.

19. A solid state device controller comprising:

a first electrical connector configured to be electrically connected to a direct current (DC) renewable energy electrical power source;

a second electrical connector in electrical communication with said first electrical connector, wherein said second electrical connector is configured to be electrically connected to a DC electrical powered device;

circuitry in communication between said first electrical connector and said second electrical connector, wherein said circuitry is configured to convert said supplied DC electrical power to DC electrical power supplied to said DC electrically powered device; and a housing configured to enclose at least a portion of said first electrical connector, said second electrical connector, and said circuitry, wherein said housing is further configured to be removably received by a service panel assembly.

20. The solid state device controller of claim 19 further comprising:

a third electrical connector configured to be in electrical communication with an alternating current (AC) power source; and a fourth electrical connector in communication with said third electrical connector, said fourth electrical connector configured to be in electrical communication with a DC electrically powered device.

21. The solid state device controller of claim 19 further comprising a controller in communication with at least one of said first electrical connector, said second electrical connector, and said circuitry, wherein said controller is configured to control said conversion of said supplied DC electrical power input to emitted said DC electrical power output.

22. The solid state device controller of claim 21, wherein said controller is configured to be in communication with a master controller, wherein said master controller is configured to be in communication with at least one of said DC electrical power source and said DC electrical powered device.

* * * * *